US008662245B1

(12) United States Patent
Hall et al.

(10) Patent No.: US 8,662,245 B1
(45) **Date of Patent: *Mar. 4, 2014**

(54) FREQUENCY RESPONSE TREATMENT OF WOOD PANELING

(75) Inventors: James L. Hall, Tampa, FL (US); Daniel P. Hess, Lutz, FL (US)

(73) Assignee: University of South Florida, Tampa, FL (US)

( * ) Notice: Subject to any disclaimer, the term of this patent is extended or adjusted under 35 U.S.C. 154(b) by 326 days.

This patent is subject to a terminal disclaimer.

(21) Appl. No.: 13/173,385

(22) Filed: Jun. 30, 2011

Related U.S. Application Data

(63) Continuation-in-part of application No. 12/185,906, filed on Aug. 5, 2008, now Pat. No. 7,977,555, which is a continuation-in-part of application No. 11/668,031, filed on Jan. 29, 2007, now Pat. No. 7,932,457.

(60) Provisional application No. 60/763,021, filed on Jan. 27, 2006.

(51) Int. Cl.
*G10D 3/00* (2006.01)

(52) U.S. Cl.
USPC ..... 181/198; 181/284; 181/294

(58) Field of Classification Search
USPC ..... 181/198, 294, 284–286
See application file for complete search history.

(56) References Cited

U.S. PATENT DOCUMENTS 579,605 A * 3/1897 Pierce ..... 84/173
1,197,116 A 9/1916 Floyd
1,836,089 A 12/1931 Schweitzer
2,911,872 A 11/1959 Carl
3,194,870 A 7/1965 Tondreau et al.
3,774,009 A 11/1973 Hodges
3,824,343 A 7/1974 Dahlquist (Continued)

FOREIGN PATENT DOCUMENTS

WO 2007089720 A3 8/2007

OTHER PUBLICATIONS

Farquhar et al., Fracture Mechanics and Its Relevance to Botanical Structures, American Journal of Botany, 2006, vol. 93, No. 10, pp. 1449-1454.

(Continued)

*Primary Examiner* — David S. Warren
(74) *Attorney, Agent, or Firm* — Robert J. Varkonyi; Anton J. Hopen; Smith & Hopen, P.A.

(57) ABSTRACT

Disclosed is a method for modifying the frequency response of a wood panel within an acoustical structure such as a studio or concert hall. The modification is imparted by exciting the wood paneling with acoustic energy. Frequency response is the measure of a system's spectrum response at the output to a signal of varying frequency (but constant amplitude) at its input. The acoustic energy includes at least one excitation frequency, which is preferably in the audible spectrum (20 to 20,000 Hz). The use of acoustic energy from the remote source provides non-contact excitation of the wood paneling. In one embodiment, the acoustic energy is at least one sound wave which comprises at least one resonant frequency of the wood paneling, at least one acoustic mode of the wood paneling, at least one discrete broadband frequency, a composite frequency (including multiple broadband frequencies, white noise and pink noise) or any combination thereof.

20 Claims, 12 Drawing Sheets

(56) References Cited

U.S. PATENT DOCUMENTS

| | | | | |
|---|---|---|---|---|
| 3,825,666 | A | 7/1974 | Jaggers | |
| 4,245,540 | A | 1/1981 | Groupp | |
| 4,348,552 | A | 9/1982 | Siccone | |
| 4,387,297 | A | 6/1983 | Swartz et al. | |
| 4,496,831 | A | 1/1985 | Swartz et al. | |
| 4,538,072 | A | 8/1985 | Immler et al. | |
| 4,593,186 | A | 6/1986 | Swartz et al. | |
| 5,023,824 | A | 6/1991 | Chadima, Jr. et al. | |
| 5,031,501 | A | 7/1991 | Ashworth | |
| 5,067,573 | A | 11/1991 | Uchida | |
| 5,168,145 | A | 12/1992 | Tackett et al. | |
| 5,198,651 | A | 3/1993 | Barkan et al. | |
| 5,410,141 | A | 4/1995 | Koenck et al. | |
| 5,422,442 | A | 6/1995 | Gouda et al. | |
| 5,468,952 | A | 11/1995 | Alexander et al. | |
| 5,475,214 | A | 12/1995 | DeFranco et al. | |
| 5,488,575 | A | 1/1996 | Damelson et al. | |
| 5,537,908 | A | 7/1996 | Rabe et al. | |
| 5,600,081 | A | 2/1997 | Simjian | |
| 5,600,121 | A | 2/1997 | Kahn et al. | |
| 5,612,720 | A | 3/1997 | Ito et al. | |
| 5,657,201 | A | 8/1997 | Kochis | |
| 5,703,626 | A | 12/1997 | Itoh et al. | |
| 5,736,726 | A | 4/1998 | VanHorn et al. | |
| 5,744,791 | A | 4/1998 | Isaac et al. | |
| 5,763,864 | A | 6/1998 | O'Hagan et al. | |
| 5,801,371 | A | 9/1998 | Kahn et al. | |
| 5,911,396 | A | 6/1999 | Bireley | |
| 5,969,328 | A | 10/1999 | Kunert | |
| 6,036,098 | A | 3/2000 | Goldman et al. | |
| 6,040,510 | A | 3/2000 | Yaun | |
| 6,065,679 | A | 5/2000 | Levie et al. | |
| 6,068,307 | A | 5/2000 | Murphy | |
| 6,109,528 | A | 8/2000 | Kunert et al. | |
| 6,112,993 | A | 9/2000 | Svetal et al. | |
| 6,170,748 | B1 | 1/2001 | Hash et al. | |
| 6,179,135 | B1 | 1/2001 | Simpson | |
| 6,320,113 | B1 * | 11/2001 | Griffin et al. | 84/738 |
| 6,394,355 | B1 | 5/2002 | Schlieffers et al. | |
| 6,410,865 | B1 | 6/2002 | Liu et al. | |
| 6,415,982 | B2 | 7/2002 | Bridgelall et al. | |
| 6,448,488 | B1 * | 9/2002 | Ekhaus et al. | 84/735 |
| 6,495,784 | B2 | 12/2002 | Yoon et al. | |
| 6,497,368 | B1 | 12/2002 | Friend et al. | |
| 6,605,765 | B1 | 8/2003 | Johnson | |
| 6,708,883 | B2 | 3/2004 | Krichever | |
| 6,722,569 | B2 | 4/2004 | Ehrhart et al. | |
| 6,822,853 | B2 | 11/2004 | Wulff et al. | |
| 7,064,745 | B2 | 6/2006 | Kim | |
| 7,069,061 | B2 | 6/2006 | Gammon et al. | |
| 7,195,169 | B2 | 3/2007 | Bhatia et al. | |
| 7,227,068 | B1 | 6/2007 | Van Doren | |
| 7,259,310 | B2 | 8/2007 | Wilfer | |
| 7,932,457 | B2 | 4/2011 | Hall et al. | |
| 7,968,779 | B2 * | 6/2011 | Courtright et al. | 84/320 |
| 7,977,555 | B2 | 7/2011 | Hall et al. | |
| 7,977,565 | B1 * | 7/2011 | Lye | 84/723 |
| 8,283,551 | B2 * | 10/2012 | Lye | 84/723 |
| 2001/0042681 | A1 | 11/2001 | Yoon et al. | |
| 2004/0060417 | A1 | 4/2004 | Janes et al. | |
| 2004/0252851 | A1 | 12/2004 | Braun | |
| 2004/0255753 | A1 | 12/2004 | Wilfer | |
| 2005/0000348 | A1 | 1/2005 | Workman | |
| 2005/0011951 | A1 | 1/2005 | Chang et al. | |
| 2005/0155481 | A1 | 7/2005 | Yu | |
| 2005/0252363 | A1 | 11/2005 | Rockett | |
| 2006/0072768 | A1 | 4/2006 | Schwartz et al. | |
| 2006/0117938 | A1 | 6/2006 | Gillette | |
| 2011/0167991 | A1 * | 7/2011 | Sanns, Jr. | 84/723 |

OTHER PUBLICATIONS

Turner, Instant Vintage, http://web.archive.org/web/20011217060900/http://www.acousticguitar.com/Gear/advice/vibration.shtml.

* cited by examiner

Fig. 4

$$P_{FF}(f) = \Sigma\,(F(f)\,F(f)^*)\,/\,n\ ,\ P_{AA}(f) = \Sigma\,(A(f)\,A(f)^*)\,/\,n\ ,\ P_{AF}(f) = \Sigma\,(F(f)\,A(f)^*)\,/\,n$$

where * indicates complex conjugate.

Fig. 5

$$FR(f) = \frac{P_{AF}(f)}{P_{FF}(f)}$$

Fig. 6

$$\gamma^2(f) = \frac{P_{AF}(f)\,P_{AF}(f)^*}{P_{FF}(f)\,P_{AA}(f)}$$

Violin 1

Violin 2

Violin 3

Violin 4

Guitar 1

Guitar 2

Guitar 3

GUITAR-1

GUITAR-1

GUITAR-2

FREQUENCY RESPONSE TREATMENT OF WOOD PANELING

CROSS REFERENCE TO RELATED APPLICATIONS

This application is a continuation-in-part to U.S. patent application Ser. No. 12/185,906 filed Aug. 5, 2008 which is a continuation-in-part of U.S. patent application Ser. No. 11/668,031, filed Jan. 29, 2007, now issued U.S. Pat. No. 7,932,457, which claims priority to U.S. Provisional Application 60/763,021 filed on Jan. 27, 2006, which is incorporated herein by reference.

BACKGROUND OF THE INVENTION

The acoustic properties of wood are well documented. The selection of wood as a construction material, particularly for acoustic applications such as instruments and concert halls, is important because the sound is produced by the vibrations of the material itself. The characteristics which determine the acoustic performance of a material are density, Young's modulus, and loss coefficient (see Wegst, U. 2006. Wood for sound. *American Journal of Botany* 93: 1439-1448). Wegst has shown that Young's modulus (measurement of a material's stiffness) for a given species of wood is almost linearly correlated to density.

Pitch, loudness and timbre represent the three auditory attributes of sound. The term pitch represents the perceived fundamental frequency of a sound, which can be precisely determined through physical measurement. The intensity of a sound is a function (the square of the amplitude) of the vibration of the originating source. In addition to a pitch associated with a sound, an acoustic body also has a pitch which is expressed by the spectrum of frequencies it creates when vibrated. The acoustics of a given body depend on shape as well as the material from which the body is made (Wegst).

It is known that stringed instruments are enhanced with age, specifically from actual playing-time (or use). The wood used to construct the instruments provides a more pleasing result as the instrument is played. It is for this reason that such a high value is placed on vintage instruments. By the same token, the acoustical properties of wood-paneled studios and concert halls change with age.

The vibration associated with use of the instrument causes subtle changes in the pliability of the wood in the instrument and the surrounding wood in its environment. Vibration has equal effects on the natural resins within the wood. Moreover, finishes such as lacquer, commonly applied to wooden panels, are affected by vibration resulting in the loss of plasticizers. These changes usually take many years.

Others have sought to shorten the time needed to gain the desired effects of aging. For example, U.S. Pat. No. 2,911,872 describes a motor powered apparatus which mechanically bows the strings of a violin. The system can be set up such that the strings can be played at any selected position and bowed in succession. U.S. Pat. No. 5,031,501 describes a device comprising a small shaker board which is attached to the sound board of a stringed instrument. The shaker is then driven by a musical signal to simulate what the sound board experiences as it is being played. These approaches both provide automatic means to simulate playing the instrument, thus allowing the instrument to be aged without the expenditure of time or effort by a real musician. However, both approaches take a prolonged period of time to age a new instrument because they basically simulate playing the instrument; aging occurs in real time.

U.S. Pat. No. 5,537,908 developed a process for wooden stringed instruments that utilizes broadband vibration from a large electromagnetic shaker and controller. The instrument is attached to a specially designed shaker fixture and then subjected to broadband vibration excitation. The broadband input provides excitation over the frequency range of 20 to 2,000 Hz, providing accelerated aging compared to single tone inputs from earlier methods. Experienced musicians attested to hearing improvement in sound producing ability after application of this method. In addition, simple vibration measurements showed an increase in instrument response. The process, however, requires direct contact or coupling with a large electromagnetic shaker which can and result in damage to the instruments processed (or in the case of the present invention, wood paneling). In addition, the upper frequency limit of such shakers is about 2,000 Hz.

In addition to its use in the construction of instrument, wood is an important component in the acoustic makeup of structures. Concert halls, in particular, are meticulously constructed to maximize acoustic effect. To this end, great care goes into the selection and placement of construction materials. Two important factors, with regard to room acoustics, are reverberation time as well as the level of reverberant sound. Wood is often used to maximize acoustic effect through the placement of wooden panels which act as reflectors and resonators, and the use of wood flooring and stage construction are necessary for the optimization of the sound field and reverberation time (Wegst. 2006).

An acoustic system, such as a musical instrument or concert hall, possesses an acoustic resonance. Resonance refers to the tendency of a system to oscillate at maximum amplitude at certain frequencies, known as the system's resonance frequencies (or resonant frequencies). At these frequencies, even small periodic driving forces produce large amplitude vibrations, because the system stores vibrational energy.

Acoustic resonance is the tendency of the acoustic system to absorb more energy when the frequency of its oscillations matches the system's natural frequency of vibration (its resonance or resonant frequency) than it does at other frequencies. Most objects have more than one resonance frequency, especially at harmonics of the strongest resonance. An acoustic system will easily vibrate at the strongest frequencies, and vibrate to a lesser degree at other frequencies. Materials, such as wood, posses the ability to react to its particular resonance frequency even when it is part of a complex excitation, such as an impulse or a wideband noise excitation. The net effect is a filtering-out of all frequencies other than its resonance.

Applicants have advanced the art in the field of acoustically aging instruments suspended inside an enclosure as provided in U.S. Pat. No. 7,932,457 issued Apr. 26, 2011. However, there is a long-felt but unfulfilled need to acoustically age installed wooden panels inside an acoustical structure. For the purpose of this specification an acoustical structure is defined as a room in which an audible performance occurs. Such performances may include, but are not limited to, concerts, dramas, readings or sound recordings.

SUMMARY OF INVENTION

In one embodiment, the invention includes a method of modifying the frequency response of a wooden panel in an acoustical structure by applying acoustical energy from the acoustical energy source to the wooden panel. The panel can be any form for use in an acoustical system such as unfinished wood, finished wood, ceiling mounted, wall-mounted, free-standing and/or flooring. In one embodiment, the acoustical energy source is suspended in the acoustical structure which allows free vibration and prevents dampening from contact with a support surface.

The acoustical energy has a predetermined frequency selected from the group consisting of at least one resonant frequency of the wooden panel, at least one discrete broadband frequency, a composite broadband frequency and a combination thereof. In one embodiment, the excitation frequency is substantially maintained for a predetermined time (i.e. one week or 168 hours). Results of the treatment can be modified by altering the treatment time and/or intensity. In an illustrative embodiment, the article is treated between about 90 and 134 dB. The acoustic energy can be applied perpendicularly to the longitudinal axis of the article or in parallel. In yet another embodiment, the acoustical energy source is repositioned about the acoustical structure in preselected intervals and distances.

Applicants note that 130 dB sound level is unbearable (and unsafe to human ears) without well designed enclosures or ear plugs or earmuffs. The extremely high sound levels are still necessary for wood panels and flooring in concert halls and studios. However, in this case, ear protection would have to be used. Also, sealing all doors and windows would help contain the sound (although often this is inherent in studio design). Suspending the energy source would be necessary for wooden floor treatments. Repositioning the energy source would be helpful especially in halls and large studios.

In yet another alternative embodiment of the invention, one or more noise cancellation speakers attenuate the sound produced by the acoustical energy source treating the wood panels outside the acoustical structure. Active noise control is deployed through the use of a computing device. The computing device analyzes the waveform of the background aural or nonaural noise, then generates a signal reversed waveform to cancel it out by interference. This waveform has identical or directly proportional amplitude to the waveform of the sound generated inside the structure and subsequently modified by the acoustics of the concert hall or studio. However, the noise cancelling waveform signal is inverted. This creates the destructive interference that reduces the amplitude of the perceived sound output by the wood panel treatment. This embodiment may be particularly useful in large scale treatments that occur proximate to other facilities that will be occupied during wood panel treatment (e.g., classrooms, offices, businesses and even residences).

BRIEF DESCRIPTION OF THE DRAWINGS

For a fuller understanding of the nature and objects of the invention, reference should be made to the following detailed description, taken in connection with the accompanying drawings, in which:

FIG. 4 is the formula for calculating the average power and cross spectra.

FIG. 5 is the formula for computing frequency response.

FIG. 6 is the formula for calculating coherence $\delta^2(f)$ as a function of frequency.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

The invention includes a method for modifying the frequency response of a wooden panel within an acoustical structure by exciting the article with acoustic energy. Frequency response is the measure of a system's spectrum response at the output to a signal of varying frequency (but constant amplitude) at its input. In the audible range it is usually referred to in connection with acoustic systems.

The acoustic energy comprises at least one excitation frequency, which is preferably in the audible spectrum (20 to 20,000 Hz). The use of acoustic energy from a remote source provides non-contact excitation of the wooden panel. In one embodiment, the acoustic energy is at least one sound wave which comprises at least one resonant frequency of the wooden panel, at least one acoustic mode of the wooden panel, at least one discrete broadband frequency, a composite frequency (including multiple broadband frequencies, white noise and pink noise) or any combination thereof.

Figure 1:
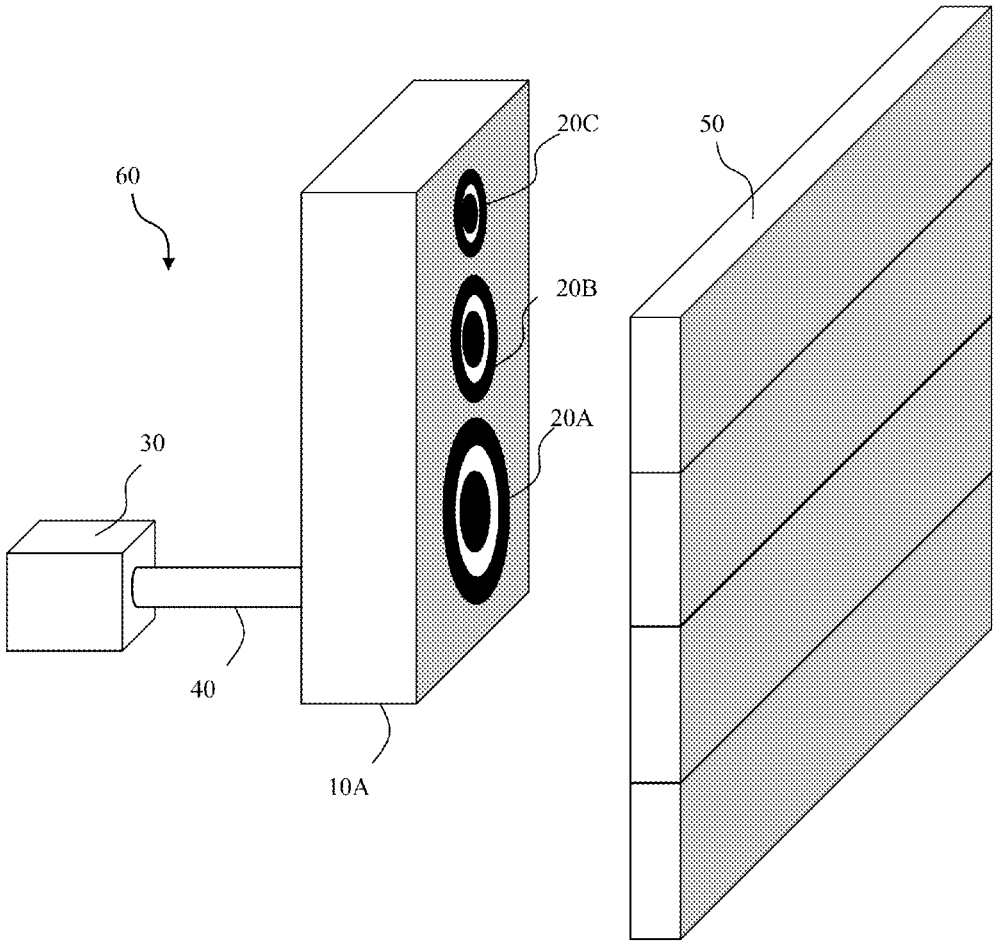
FIG. 1 is a perspective view of an illustrative device for implementing an embodiment of the invention unidirectionally upon vertically oriented wood paneling.

The acoustic energy source of one embodiment is an electromechanical transducer, or any device that converts one type of energy to another (such as converting electricity into sound waves). In an illustrative embodiment as shown in FIG. 1, the acoustic energy source is acoustical energy source 10A comprising three speakers: large 20A for the bass, midsize 20B for the midrange frequencies, and small 20C for the high frequencies. Broadband electrical signal source 30 is coupled 40 to speaker 10A. Sign 30 has a range from 20 to 20,000 Hz which drives acoustical energy source 10A to produce acoustical energy having at least one resonant frequency of wall wood panel 50, at least one acoustic mode of wall wood panel 50, and at least one discrete frequency. Collectively, acoustical energy source 10A and broadband electrical signal 30 are denoted as apparatus 60. Apparatus 60 may be incrementally positioned over a period of time to impart acoustical aging of wall wood panel 50. By way of an illustrative example, 1-30 days of acoustical treatment may be imparted to wood panel 50 at a distance of 0.5 to 10 meters.

Figure 2:
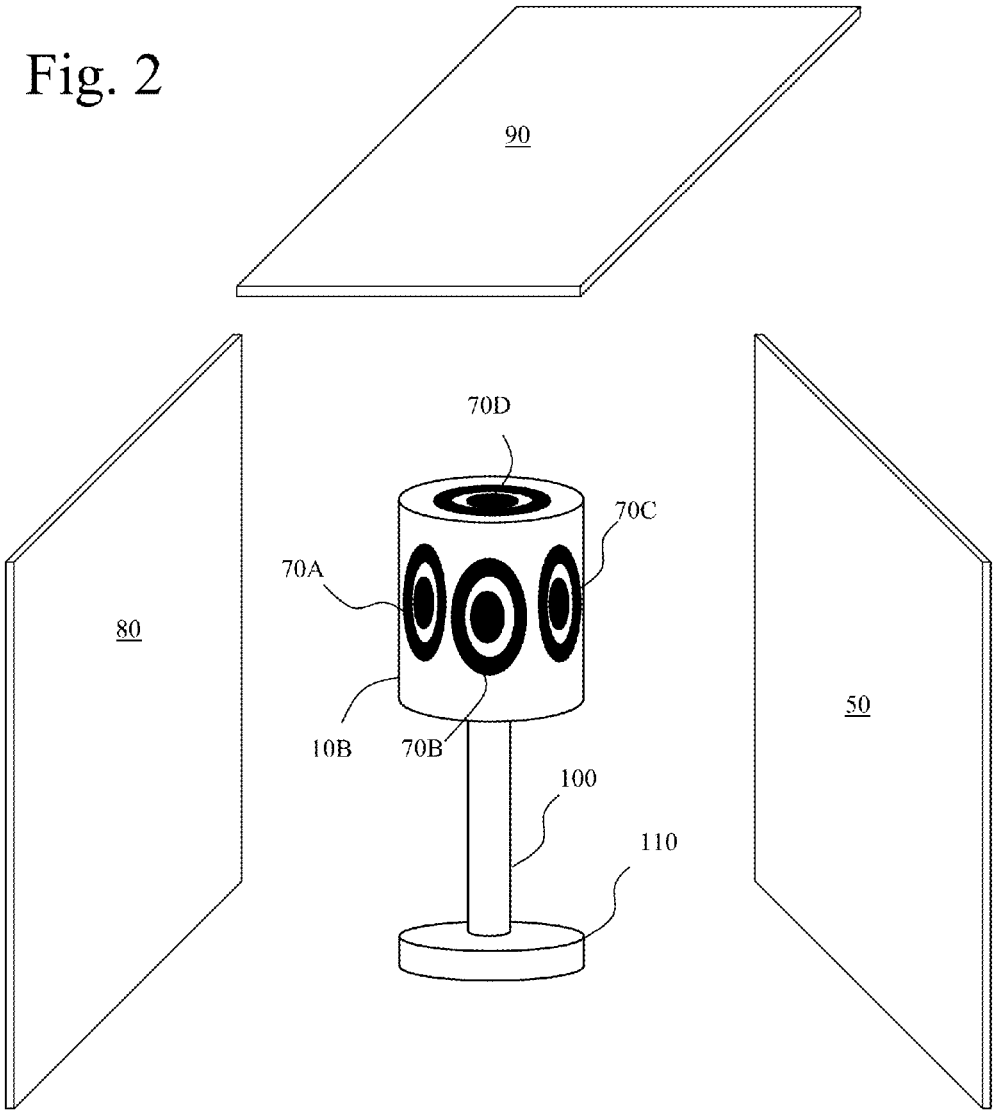
FIG. 2 is a perspective view of an illustrative device for implementing an embodiment of the invention upon ceiling and walled wood paneling.

FIG. 2 illustrates an alternative embodiment of the invention having acoustical energy source 10B directing acoustical energy in multiple directions by way of speakers 70A-D. Speaker 70A imparts treatment to wall wood panel 80. Speaker 70C imparts treatment to wall wood panel 50. Speaker 70D imparts treatment to ceiling wood panel 90. Acoustical energy source 10B is elevated by support member 100 and stabilized by support base 110. An advantage of the embodiment in FIG. 2 is its ability to impart acoustical treatment to both walls and ceiling simultaneously.

Figure 3:
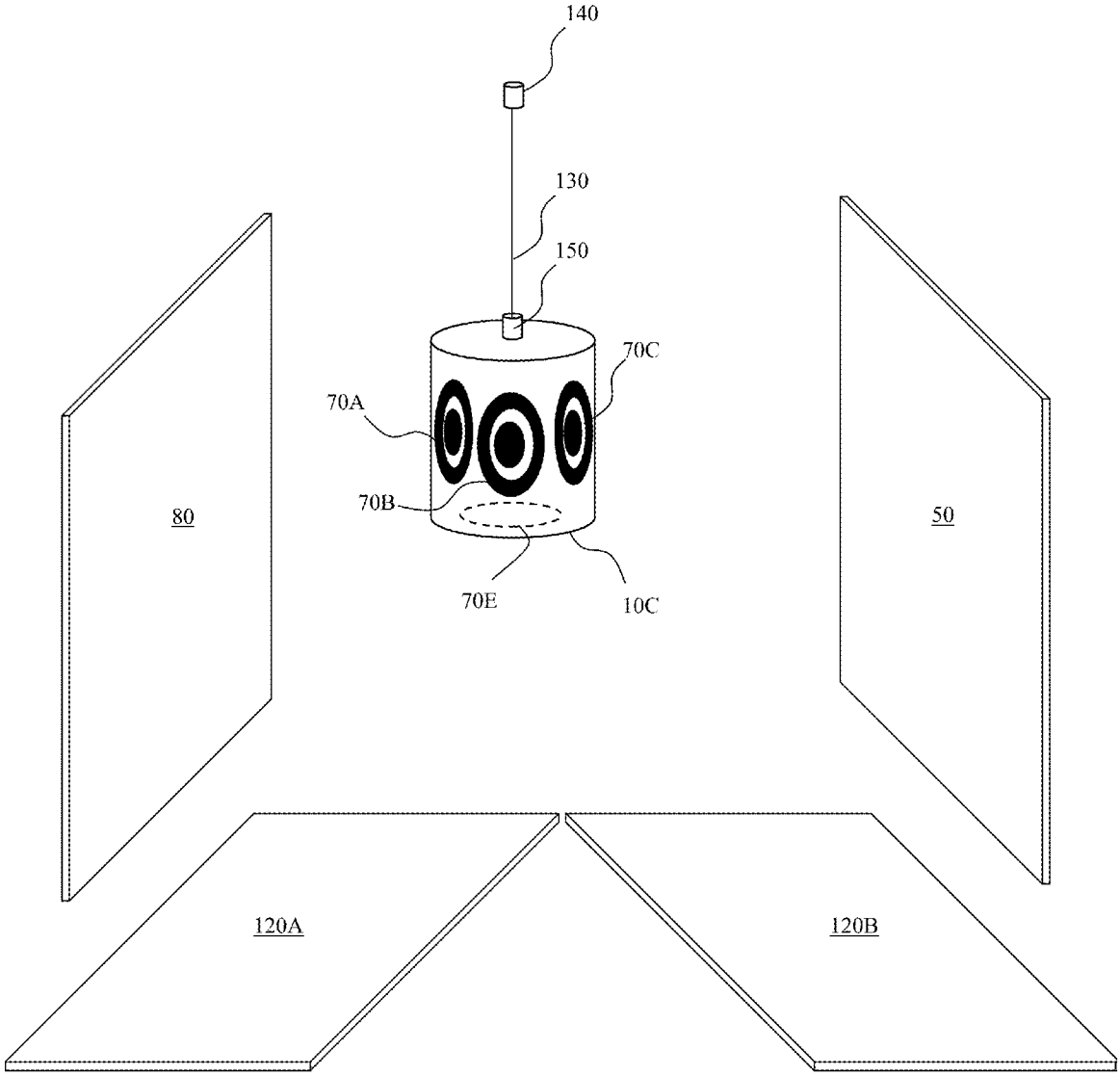
FIG. 3 is a perspective view of an illustrative device for implementing an embodiment of the invention upon a wooden floor and walled wood paneling.

Yet another embodiment of the invention is presented in FIG. 3. Acoustical energy source 10C is suspended from acoustical structure ceiling by tether 130 which includes ceiling connector 140 and acoustical energy source connector 150. Speaker 70A imparts treatment to wall wood panel 80. Speaker 70C imparts treatment to wall wood panel 50. Speaker 70E imparts treatment to floor wood panels 120A-B. An advantage of the embodiment in FIG. 3 is its unobtrusive configuration which may be raised or lowered when acoustical structure is not in use (i.e., concerts, recordings, plays and the like).

Frequency response, FR(f), was determined with the impact force F (in units of Newtons, N) to the article as the input and the resulting vibratory acceleration A (in units of g) of the article sound board as the output. It was calculated using a two-channel dynamic signal analyzer. Time trace measurements of the dynamic input and output were obtained, these measurements were windowed, and the fast Fourier transforms of these windowed time traces computed. This was repeated at least 8 times, and the average power and cross spectra are computed as using the equation in FIG. 4. The frequency response was then computed using the equation in FIG. 5.

Figure 7A:
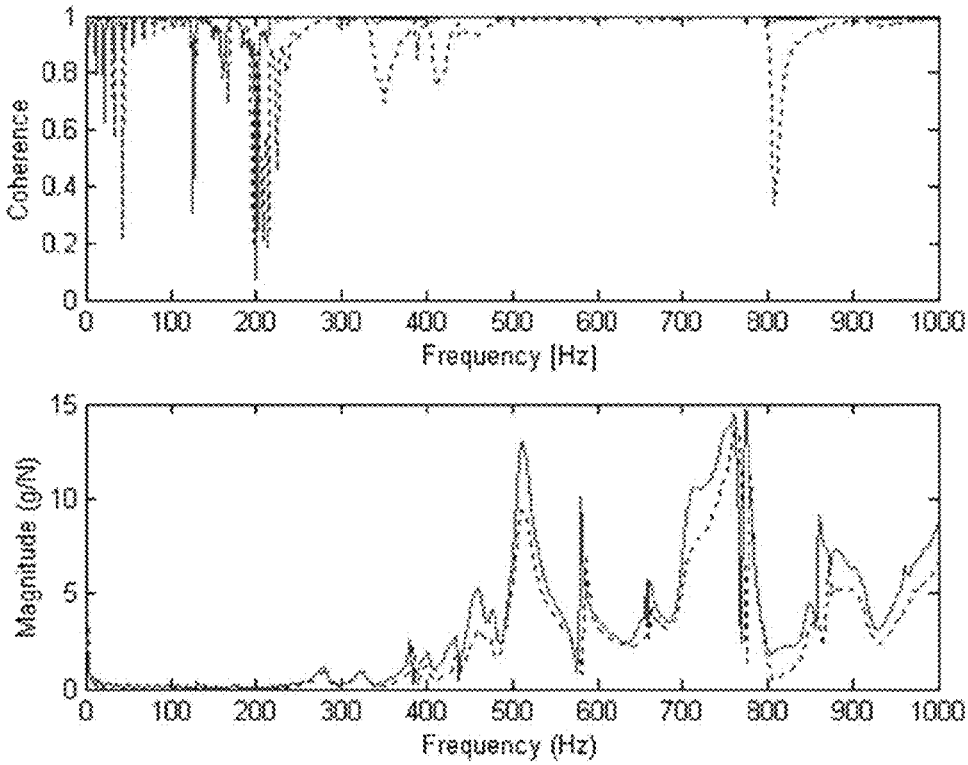
FIG. 7A is a graph showing representative initial and final frequency response data.
Figure 7B:
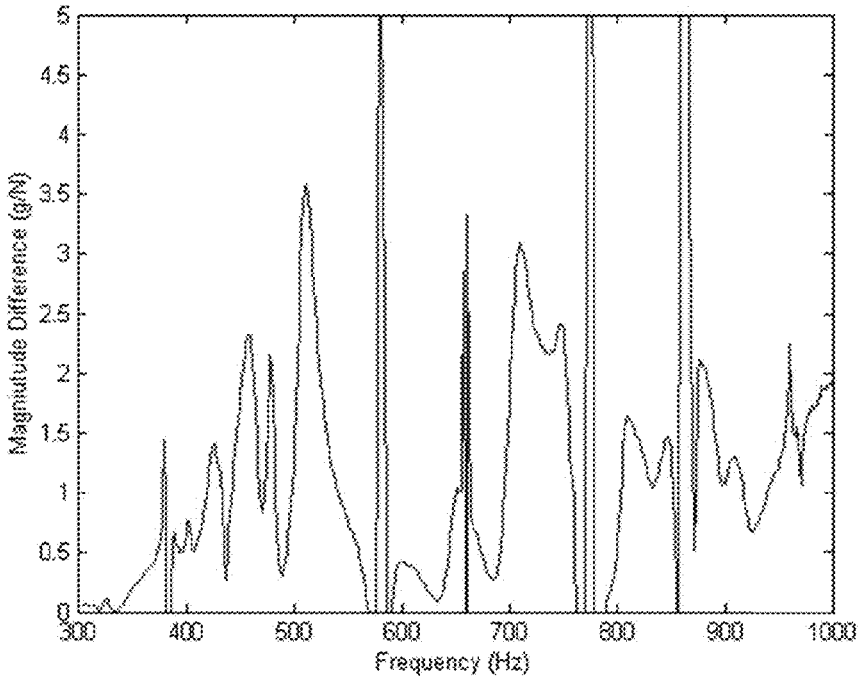
FIG. 7B is a graph showing the difference in magnitude after the aging treatment.
Figure 8:
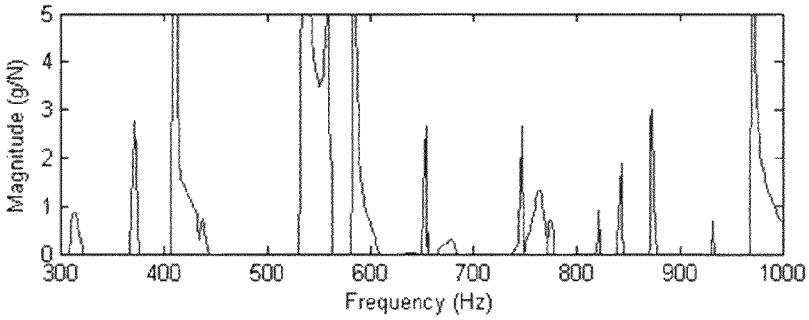
FIG. 8 shows graphs of the initial frequency response measured versus the final response for test violins.
Figure 8:
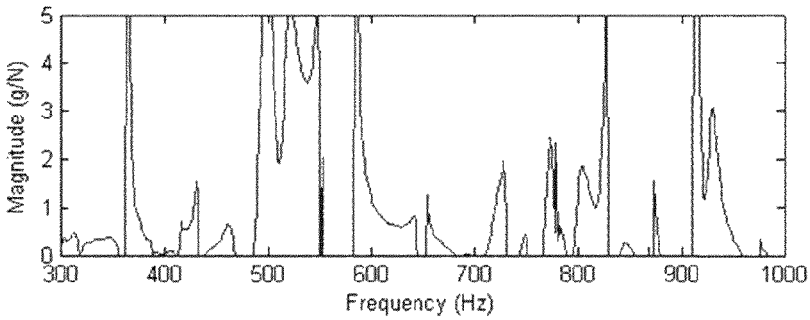
Figure 8:
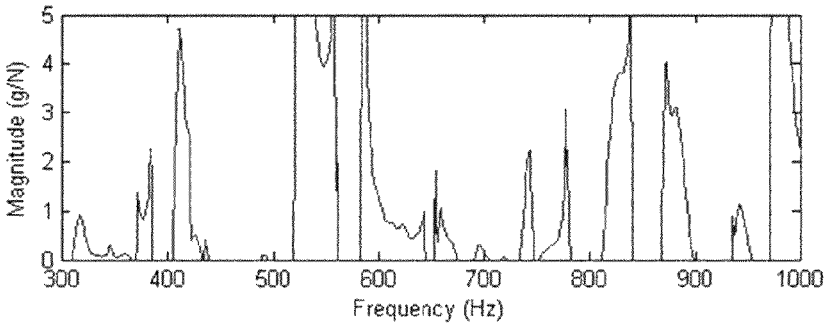
Figure 8:
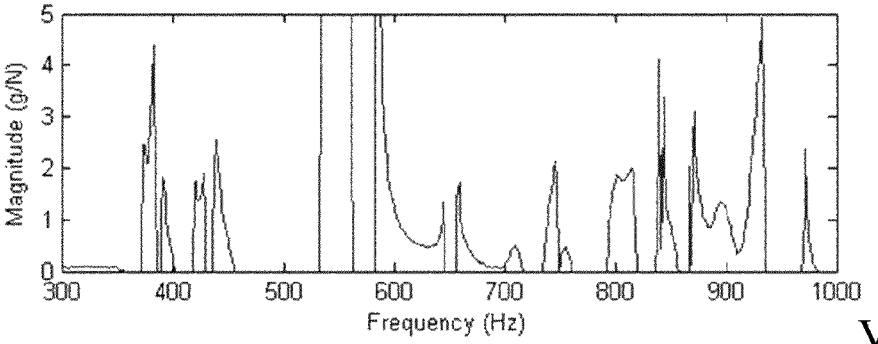
Figure 9:
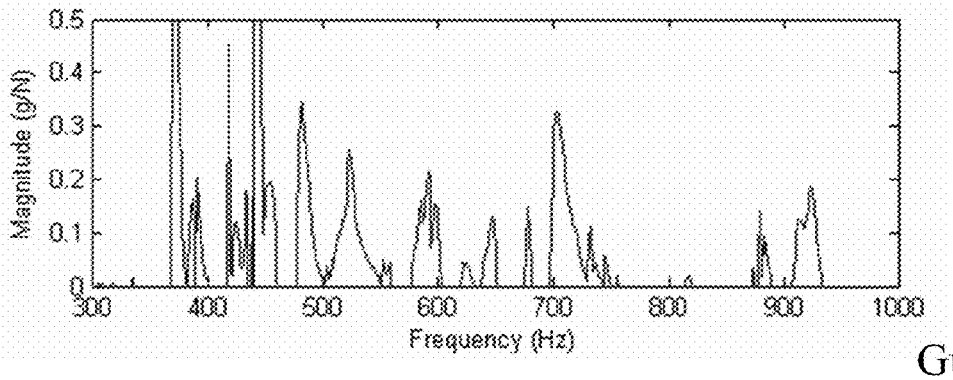
FIG. 9 shows graphs of the initial frequency response measured versus the final response for guitars.
Figure 9:
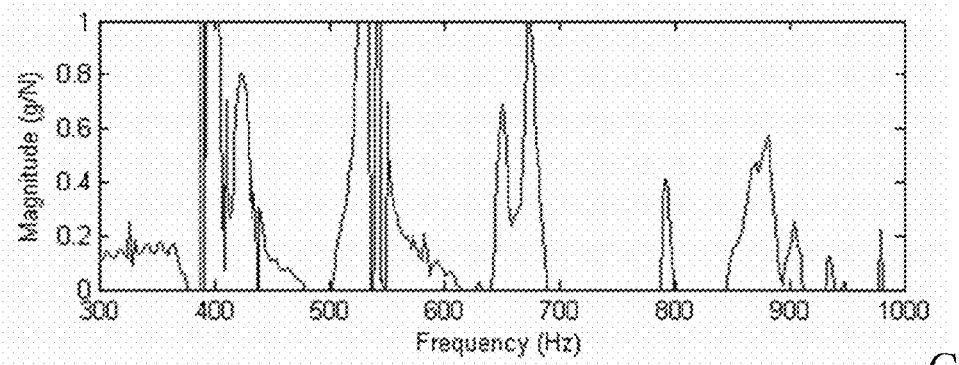
Figure 9:
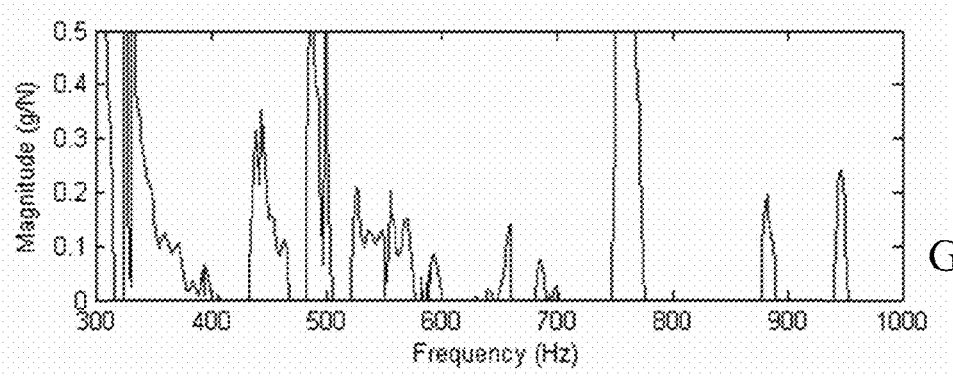
Figure 10:
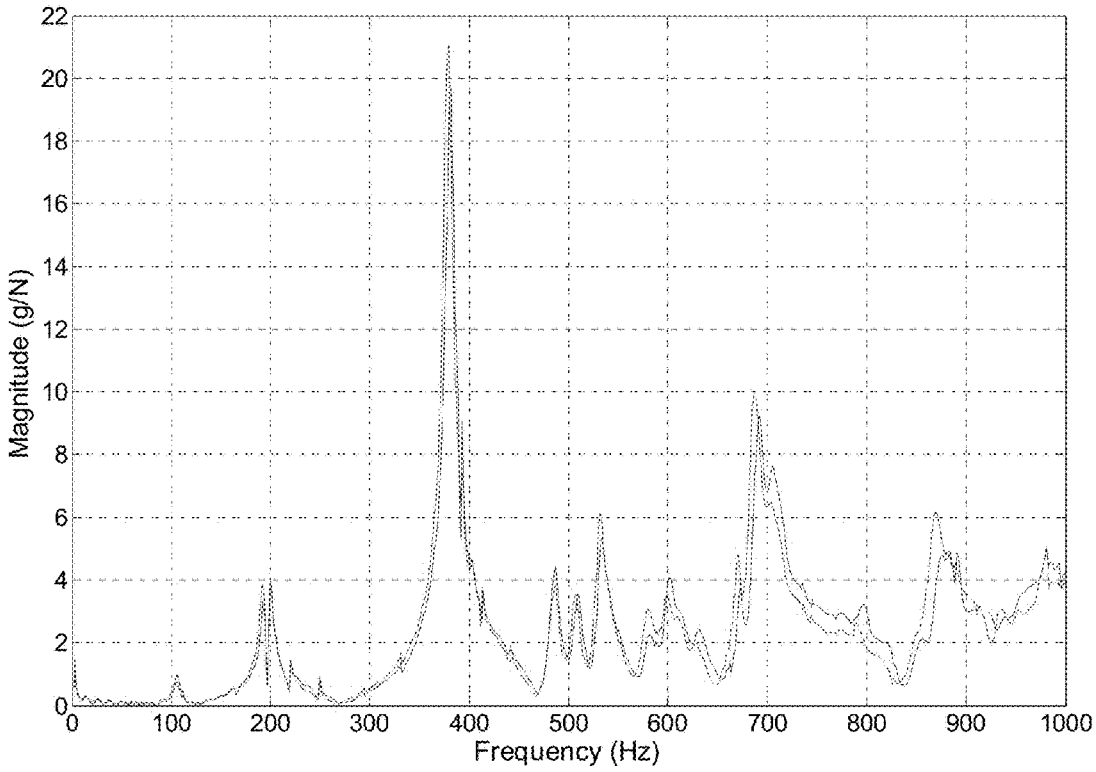
FIG. 10 shows graphs of the initial frequency response measured versus the final response for the first guitar, left position, before and after treatment for one week.
Figure 11:
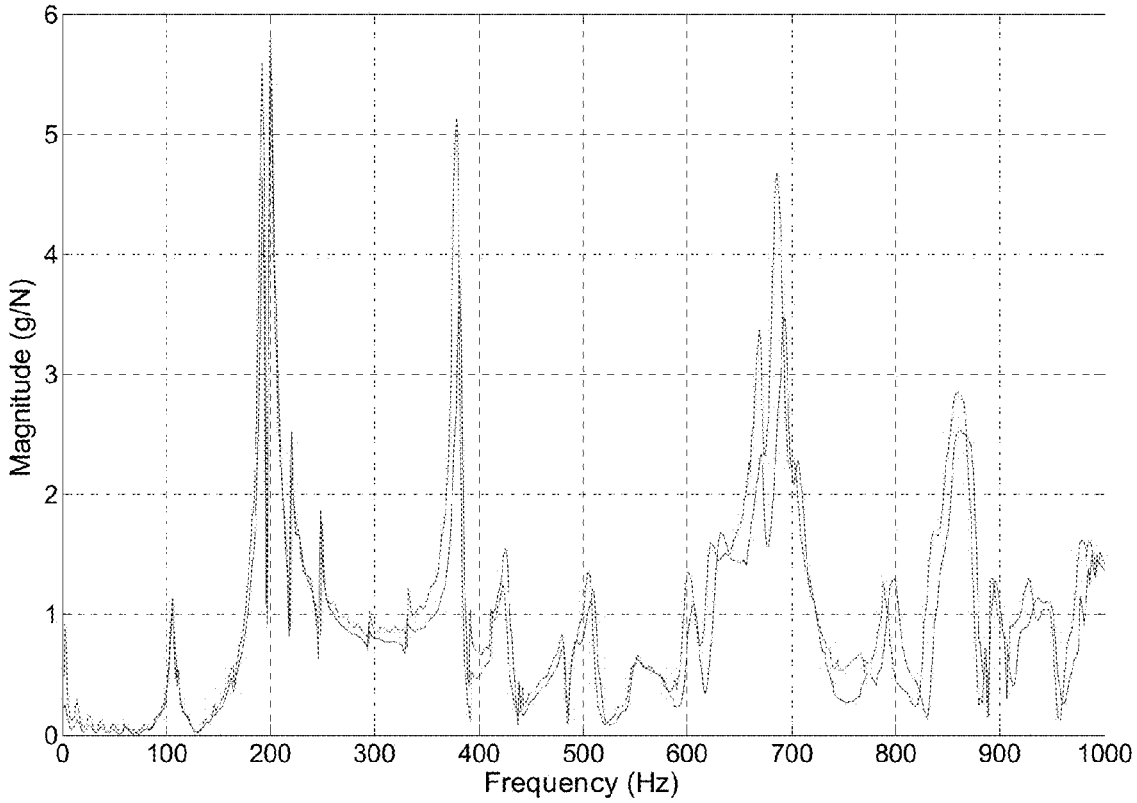
FIG. 11 shows graphs of the initial frequency response measured versus the final response for the first guitar, center position, before and after treatment for one week.
Figure 12:
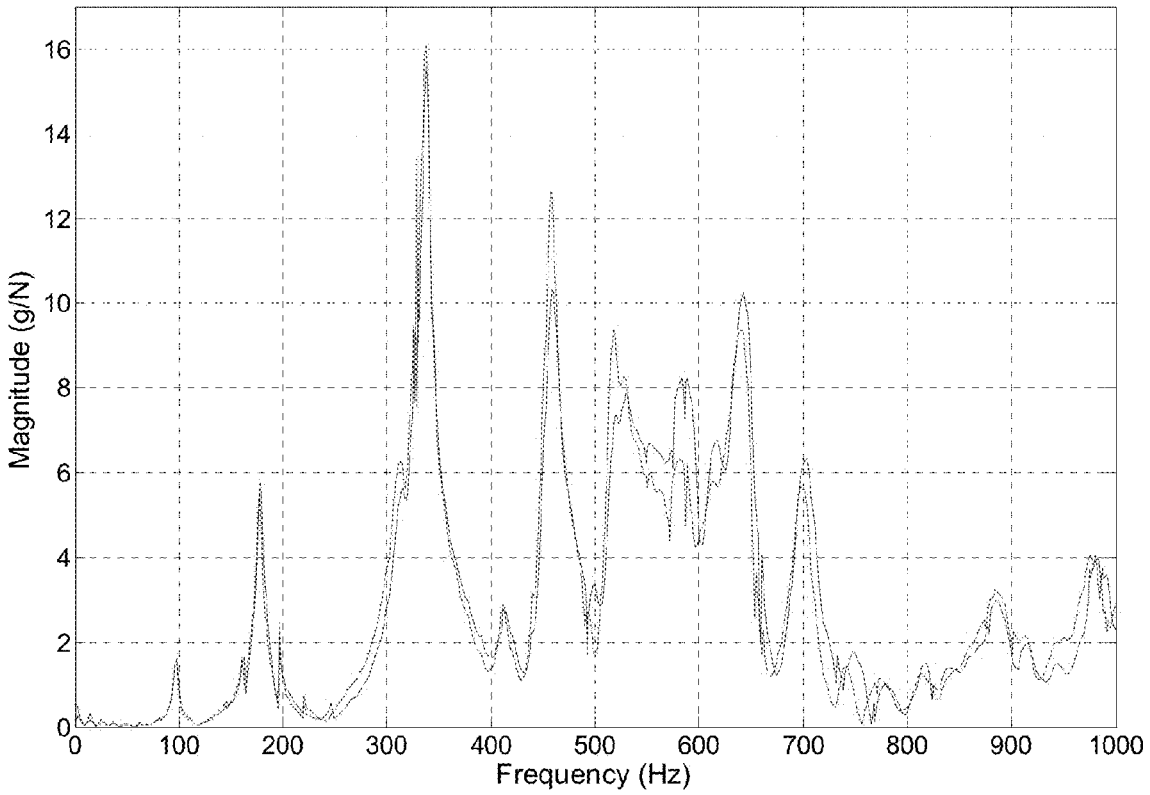
FIG. 12 shows graphs of the initial frequency response measured versus the final response for the second guitar, left position, before and after treatment for one week.
Figure 13:
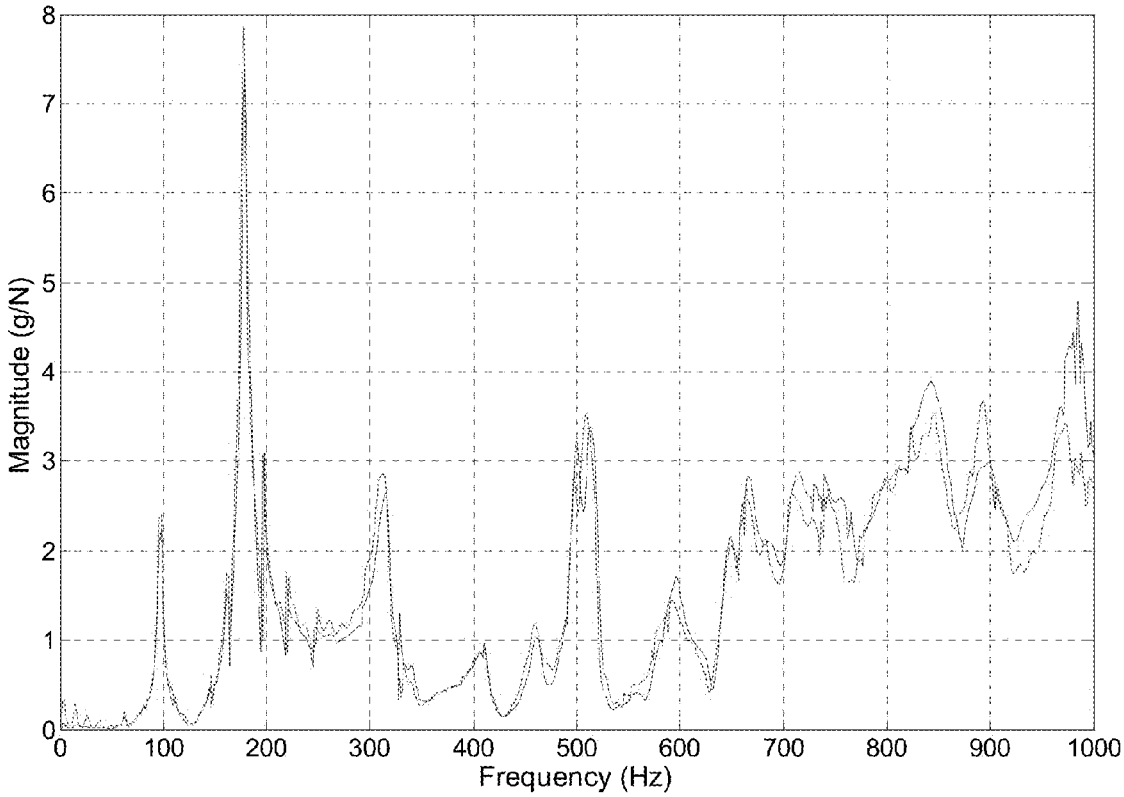
FIG. 13 shows graphs of the initial frequency response measured versus the final response for the second guitar, center position, before and after treatment for one week.

The magnitude of the response function is presented graphically in FIGS. 7-9 as g/N versus frequency. Coherence was also computed to assess the validity of the measurement. Coherence provides a measure of the power in the test instrument vibration that is caused by the power in the impact force. A coherence of 1 indicates that all of the vibratory acceleration is caused by the impact force, whereas a coherence of 0 indicates that none of the vibration is caused by the force. The coherence $\gamma^2(f)$ is a function of frequency and is the computed equation in FIG. 6).

Example I

Tests with several violins and guitars were performed. The instruments were subjected to the acoustic treatment, as describe above, continuously for several weeks using pink noise (1/f) broadband input. The instruments were assessed both before and after the treatment by experienced musicians and through frequency response measurements.

The musicians noticed a vast improvement in the tonal quality (warmer), responsiveness (increased response), and ease of tuning. The improved ease in tuning is of special interest because new instruments (especially lower end string instruments) are very difficult to get and keep in tune.

FIG. 7A shows representative initial and final (i.e., before and after) frequency response data. The coherence shows that most of the response is due to the input over most of the frequency range assessed. The magnitude is notably higher following the aging treatment. This is highlighted in FIG. 7B which shows the difference in magnitude. This data clearly shows that the instrument yields more vibratory response (g) per unit input (N) over most of the frequency range. This is consistent with one of the findings observed independently from experienced musicians.

Example II

Additional tests were performed on four violins and three guitars. The repeatability of the process is shown consistently between the ranges of 500-600 Hz and 800-900 Hz for the violins. The magnitude of change ranged from 5 to 20. A positive magnitude change means that the instruments produce more sound, or responds more for the same energy input; a significant aspect of this process. The violins used for testing ranged in quality from very inexpensive ($150.00) to moderately priced ($1200.00) with the building quality commensurate with the price paid. FIG. 8 shows the initial frequency response measured versus the final response for the violins.

The repeatability of the process is consistent between the ranges of 700-900 Hz for the guitars (FIG. 9). The magnitude of change ranged from 0 to 1. Even though the magnitude change is significantly less than the results found for the violin, this is still significant.

Example III

Two guitars were treated for a period of one week (168 hours) with the method as described above. The guitars were suspended at the neck. Padding was used to protect their surfaces. The acoustic energy was non-contact, broadband audio at a sound level of 110 dB.

The vibratory response of the guitars was assessed before and after the treatment using impact testing. For this test, the guitars were suspended on elastic bands under the nut and at the end pin. The impact was applied on the bass side of the bridge with a PCB model 086D80 hammer with a vinyl tip and a sensitivity of 59.5 N/V, which provides fairly uniform excitation up to 1,000 Hz. A spring and a positioning guide were used to provide repeatable hammer hits.

The vibration of the guitars was measured with a PCB model 309A accelerometer placed at two different positions: (a) on the bass or left side of the bridge (one inch from the bridge), and (b) at the center (one inch from the bridge). The sensitivity of the accelerometer was 200 g/V. It was attached with bees wax, which is easily removed and does not damage the guitar finish.

The vibratory response, shown in FIGS. 10 through 13, is presented as the magnitude of the frequency response with units of acceleration output per unit force input, i.e., g/N. This is computed from an average of four impact force and accelerometer measurements using a spectrum analyzer. Measurements were taken every 24 hours to monitor change and each test was done twice to check repeatability.

The data shows that one week of treatment causes an increase in amplitude in several of the vibratory modes. Physically, this means more response (measured acceleration) for the same input (measured impact force). In addition, the treatment causes a decrease in frequency of several of the resonant frequencies. This indicates increased flexibility (or decreased stiffness). Treatment at higher sound levels will potentially induce larger changes and/or reduce treatment time.

The amplitude increases observed in the testing of instruments is directly transposable to the wall, ceiling and floor wood paneling of acoustical structures. Application of the present invention to wood-paneled concert halls, studios and similar structures leads to greater response to acoustical activity and reduction of resonance in the environment.

Figure 14:
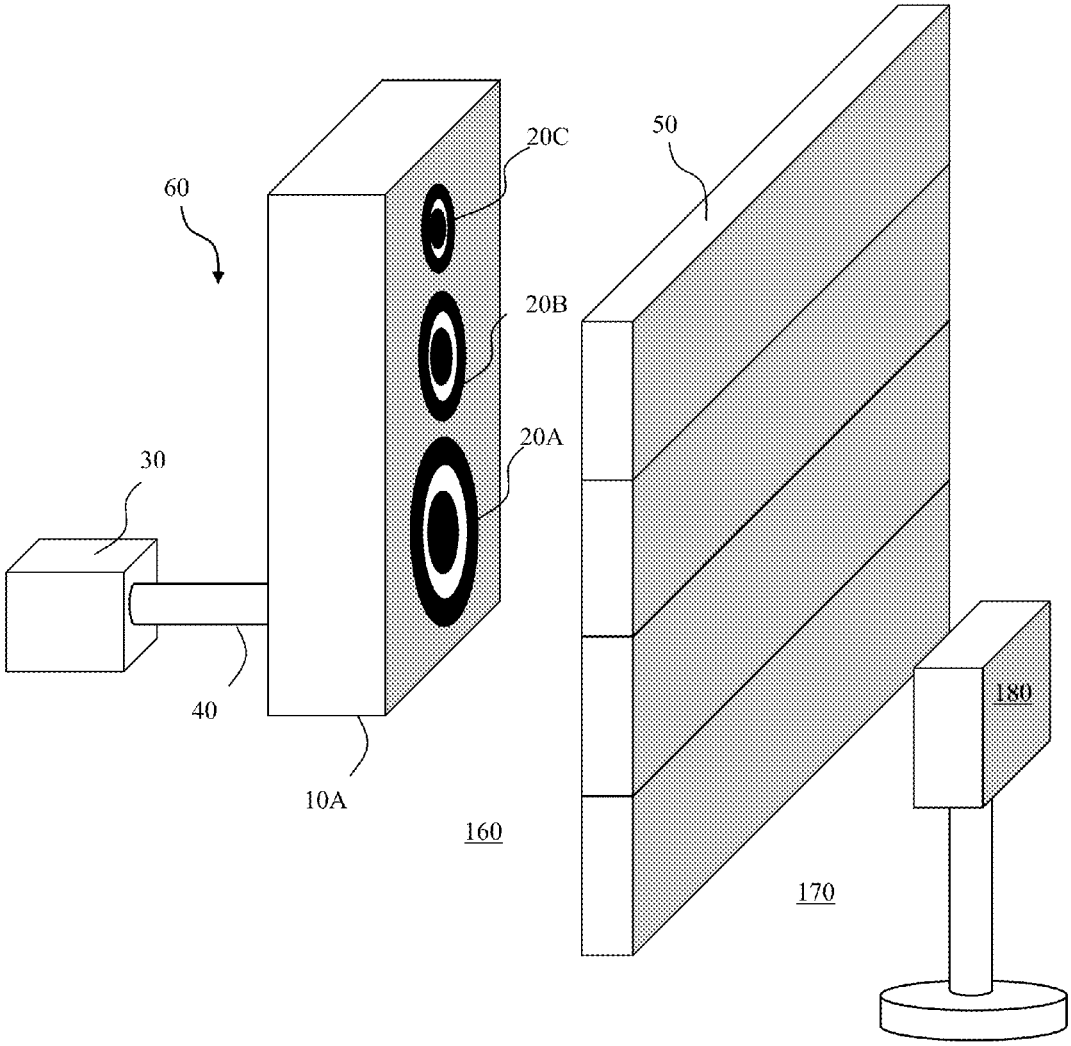
FIG. 14 is a perspective view of an illustrative device for implementing an embodiment of the invention unidirectionally upon vertically oriented wood paneling in the interior of an acoustical structure and a sound cancellation speaker attenuating noise escaping to the exterior of the acoustical structure.

An embodiment of the invention is illustrated in FIG. 14 wherein the boundary of the acoustical structure is defined by wood paneling 50. Acoustical structure interior 160 would be subject to high decibel treatment that would be dangerous to unprotected ears. Depending on the soundproofing of the acoustical structure, its exterior 170 may have perceptible to disruptive noise generated from the treatment occurring within interior 160. To attenuate any noise occurring at exterior 170, sound cancellation speaker 180 generates waveforms to lower noise at exterior 170. This is particularly advantageous when acoustical structure undergoes powerful and long-term acoustical treatment of its wood paneling. It should also be noted that interior and exterior boundaries of acoustical structure are not necessarily analogous to that of a building. For example, a concert hall typically has interior space for intermissions, ticketing and the like which, for the purposes of treating the wood paneling in the concert hall, would be considered exterior to the "treatment area." Active noise attenuation of this area would be advantageous to keep the space audibly comfortable without having to install sound deadening materials during the treatment.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between. Now that the invention has been described,

What is claimed is:

1. A method of modifying the frequency response of an acoustical structure, comprising the steps of:

placing at least one acoustical energy source inside the acoustical structure having wood paneling;

providing a broadband electrical signal having a range from 20 to 20,000 Hz to the acoustical energy source to create acoustical energy having at least one resonant frequency of the wood paneling, at least one acoustic mode of the wood paneling, and at least one discrete frequency; and applying the acoustical energy from the at least one acoustical energy source to the wood paneling in the acoustical structure.

2. The method of claim 1, wherein the frequency content of the acoustical energy is substantially maintained.

3. The method of claim 1, wherein the acoustical energy is applied to the wood paneling for a predetermined time.

4. The method of claim 1, wherein the acoustical energy has a sound pressure level greater than about 100 dB.

5. The method of claim 1, wherein the acoustical energy has a sound pressure less than about 140 dB.

6. The method of claim 1, wherein the acoustical energy is applied to the wood paneling for about 168 hours.

7. The method of claim 1, wherein the wood paneling is selected from the group consisting of ceiling panels, floor panels, wall panels and free-standing panels.

8. The method of claim 1, wherein at least one acoustical energy source is suspended in the acoustical structure.

9. The method of claim 1, wherein the acoustic energy source is substantially perpendicular to the surface of the wood paneling.

10. The method of claim 1, wherein the acoustic energy source is substantially parallel to the wood paneling.

11. A method of modifying the frequency response of an acoustical structure, by treating wood paneling inside the acoustical structure with acoustical energy, the method comprising the steps of:

placing at least one acoustical energy source inside the acoustical structure having the wood paneling;

providing a broadband electrical signal having a range from 20 to 20,000 Hz to the acoustical energy source to create acoustical energy having at least one resonant frequency of the wood paneling, at least one acoustic mode of the wood paneling, and at least one discrete frequency;

applying the acoustical energy from the at least one acoustical energy source to the wood paneling in the acoustical structure; and attenuating sound perceptible outside the acoustical structure as a result of the wood paneling treatment, the attenuation achieved by providing at least one noise-cancellation speaker producing a noise cancelling waveform.

12. The method of claim 11, wherein the frequency content of the acoustical energy is substantially maintained.

13. The method of claim 11, wherein the acoustical energy is applied to the wood paneling for a predetermined time.

14. The method of claim 11, wherein the acoustical energy has a sound pressure level greater than about 100 dB.

15. The method of claim 11, wherein the acoustical energy has a sound pressure less than about 140 dB.

16. The method of claim 11, wherein the acoustical energy is applied to the wood paneling for about 168 hours.

17. The method of claim 11, wherein the wood paneling is selected from the group consisting of ceiling panels, floor panels, wall panels and free-standing panels.

18. The method of claim 11, wherein at least one acoustical energy source is suspended in the acoustical structure.

19. The method of claim 11, wherein the acoustic energy source is substantially perpendicular to the surface of the wood paneling.

20. The method of claim 11, wherein the acoustic energy source is substantially parallel to the wood paneling.

* * * * *